US006318005B1

(12) United States Patent
André

(10) Patent No.: US 6,318,005 B1
(45) Date of Patent: Nov. 20, 2001

(54) DREDGE WITH IMPROVED AUGER SHROUD

(75) Inventor: Lee André, Baltimore, MD (US)

(73) Assignee: Ellicott Machine Corporation International, Baltimore, MD (US)

( * ) Notice: Subject to any disclaimer, the term of this patent is extended or adjusted under 35 U.S.C. 154(b) by 0 days.

(21) Appl. No.: 09/595,646

(22) Filed: Jun. 16, 2000

(51) Int. Cl.[7] ..... E02F 3/22
(52) U.S. Cl. ..... 37/329; 37/317; 37/350
(58) Field of Search ..... 37/307, 313, 317, 37/326, 329, 350, 354, 324

(56) References Cited

U.S. PATENT DOCUMENTS

| | | | | |
|---|---|---|---|---|
| 516,090 | | 3/1894 | Gullmann . | |
| 3,738,029 | * | 6/1973 | Harmon . | |
| 3,971,148 | * | 7/1976 | Deal . | |
| 4,083,134 | | 4/1978 | Oterdoom | 37/58 |
| 4,146,982 | * | 4/1979 | Norisugi . | |
| 5,060,404 | | 10/1991 | Lipford | 37/64 |
| 5,651,200 | * | 7/1997 | Walsh . | |
| 5,732,487 | | 3/1998 | Van De Kerckhove | 37/333 |

* cited by examiner

*Primary Examiner*—H. Shackelford
(74) *Attorney, Agent, or Firm*—Pearne & Gordon LLP

(57) ABSTRACT

A dredge supporting a pivotal ladder with a suction auger on its free end. A shroud assembly including front, center and rear sections surrounds a large portion of the periphery of the auger. The shroud assembly is pivotal about the axis of the auger and the front and rear sections are each independently pivotal relative to the center section so that the center section can be maintained at a relatively constant attitude independent of the inclination of the ladder and only a leading one of the front and rear sections, depending on the direction of movement of the dredge, is necessarily opened while the trailing section can remain closed adjacent to the auger. The articulation of the several shroud sections enables the suction auger head to operate in both directions with reduced turbidity and, therefore, increased efficiency.

9 Claims, 4 Drawing Sheets

DREDGE WITH IMPROVED AUGER SHROUD

BACKGROUND OF THE INVENTION

The invention relates to improvements in dredges and, in particular, to an improved suction auger head used with a ladder suspended from a barge.

PRIOR ART

U.S. Pat. No. 5,060,404 discloses a suction auger-type dredge head on a ladder suspended from a barge. The ladder pivots at one end while the opposite free end, carrying the auger or cutter head, is lowered or raised to a depth to reach and work the bottom. The auger is partially surrounded by a shroud having a center section and outer sections pivotal at opposite edges of the center section. One or the other pivoting shroud sections is raised or opened to admit bottom material to the cutting side of the auger depending on the direction the head is being moved. The shroud serves to confine the suction developed by a pump to the zone of the auger. The head can be pivoted on the ladder about an axis displaced from the head to reduce, to some extent, the effect that a change in the ladder angle or inclination has on the attitude of the shroud relative to the bottom surface and cut that the auger is making.

SUMMARY OF THE INVENTION

The invention provides dredging apparatus with a suction auger head that achieves improved operating efficiency with a novel auger shroud assembly. The shroud assembly has a generally cylindrical arcuate configuration that is formed by a series of arcuate sections. The sections are movable relative to the ladder depending on the depth and direction of travel of the auger head.

In the disclosed arrangement, the auger head shroud assembly has a center section lying between oppositely extending forward and rear sections. All of the sections are pivotal, in unison, about an axis coincident with the axis of rotation of the auger. The forward and rear sections are each independently pivotal about a respective axis adjacent its edge proximal to the center shroud. Pivotal shroud assembly movement about the auger axis adjusts for differing depth angles of the ladder. One or the other of the forward and rear sections is pivoted open depending on the direction of movement of the dredge. More specifically, the forward or rear section leading the auger in the direction of movement is pivotally opened while the other section remains closed adjacent the periphery of the auger.

The disclosed shroud construction enables the shroud to closely hug the bottom surface immediately ahead of the auger in either forward or reverse directions. Consequently, turbidity is minimized at the auger head and, as a result, high dredging efficiency is achieved.

DESCRIPTION OF THE PREFERRED EMBODIMENT

Figure 1:
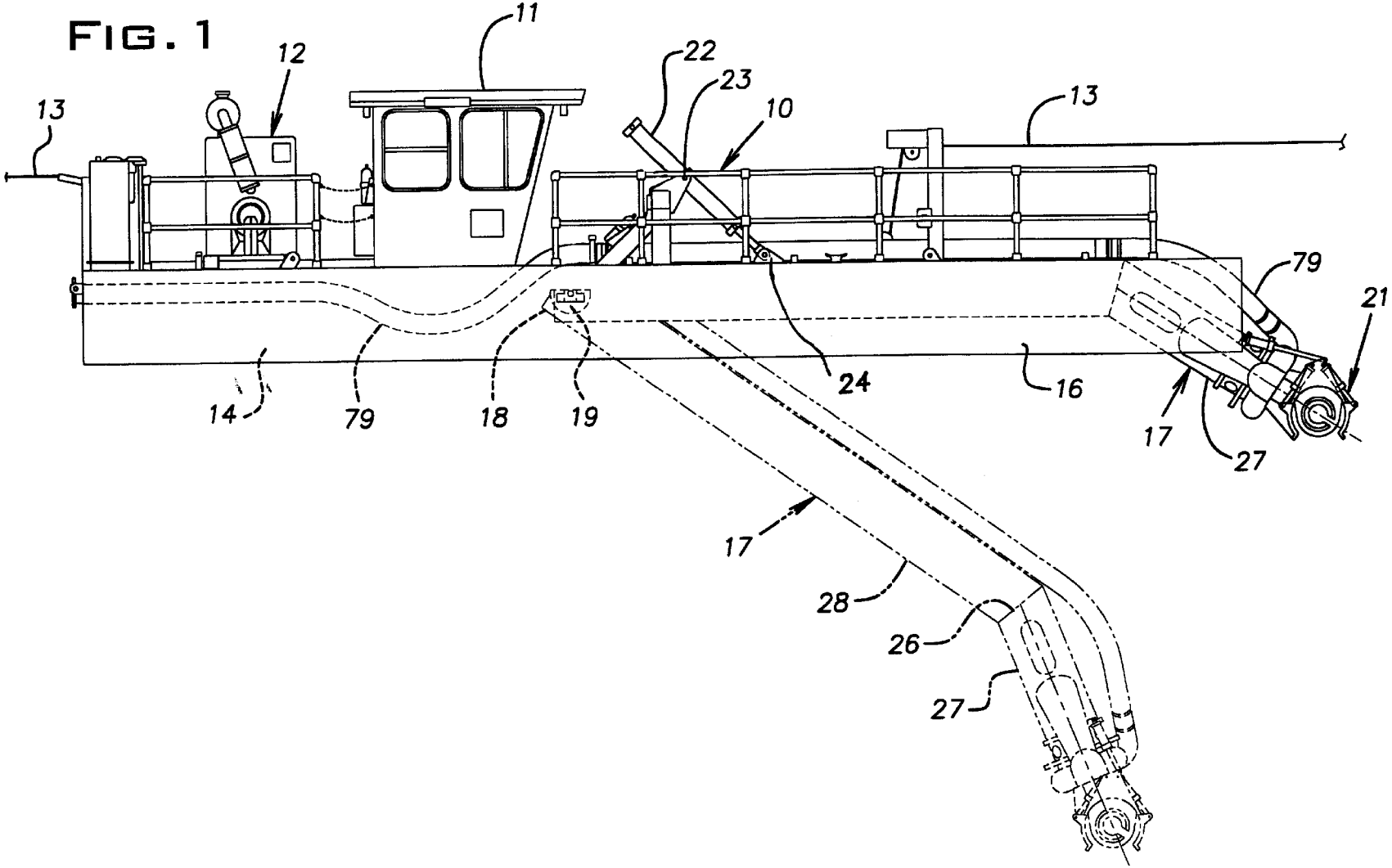
FIG. 1 is a side elevational view of a dredge barge embodying the present invention.

Referring now to the drawings and, in particular, to FIG. 1, a dredge barge 10 of generally known construction has a lever room or cabin 11 and an engine or power plant 12 for driving a hydraulic pump for operating various hydraulic motors and actuators on the barge. Traverse cable 13 extends fore and aft of the barge 10 for pulling the barge forwardly or rearwardly via a hydraulic barge mounted winch as is known in the art. A hull 14 of the barge 10 includes a pair of pontoons 16 that straddle a dredge ladder or boom 17. The ladder 17 is shown in a relatively shallow dredging position in solid line in FIG. 1 and in a relatively deep dredging position in phantom in FIG. 1. The ladder can be raised above the solid line position of FIG. 1 to a point where it is entirely above the bottom of the hull 14.

One end 18 of the ladder 17 is pivotally supported on the hull with trunnions 19. An opposite end of the ladder carries a suction auger dredge head 21. The angular position of the ladder 17 and, consequently, the depth of the dredge head 21 is controlled by a hydraulic piston and cylinder actuator 22. The actuator 22 is carried on trunnions fixed to the deck of the barge and is coupled by a clevice to a bracket 24 fixed to the ladder 17.

The major length of the ladder 17, in the illustrated construction, is fabricated from a cylindrical steel tube that is mitered at a plane or joint 26 such that a lower relatively short section 27 of the ladder drops down in a vertical plane at an obtuse angle with respect to an upper longer section 28.

Figure 3:
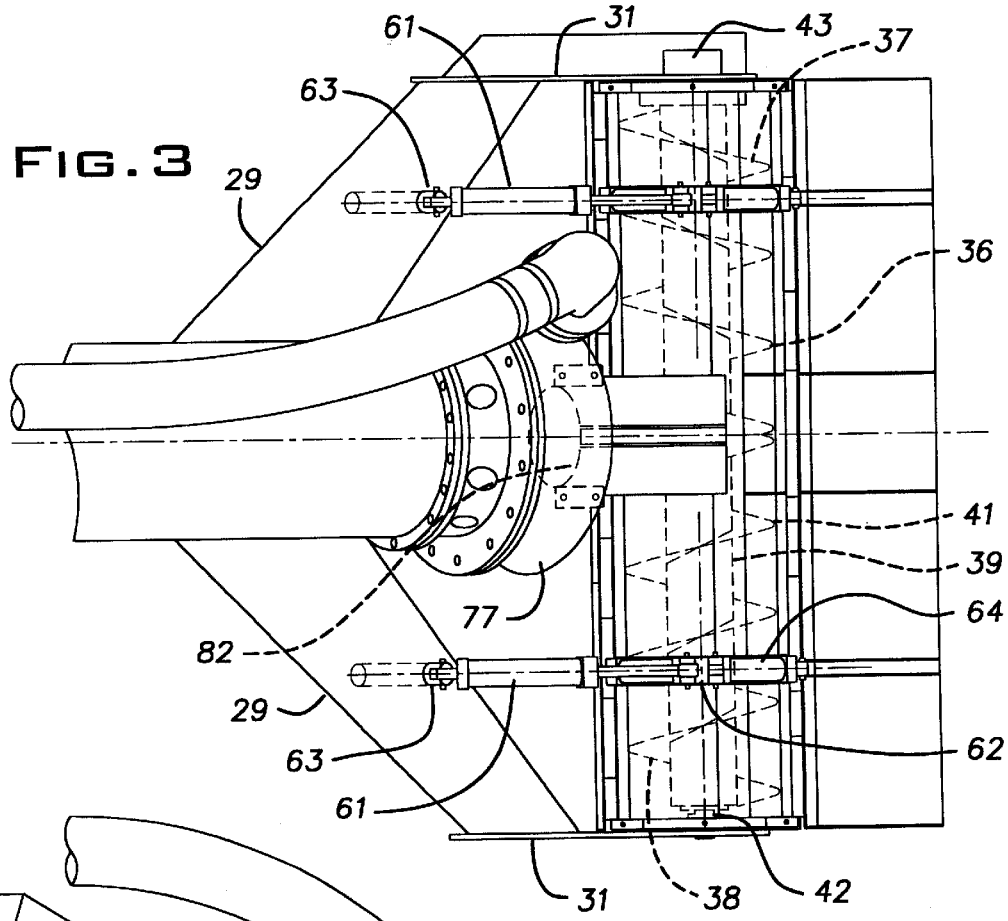
FIG. 3 is a somewhat schematic plan view of the lower section of the ladder and the suction auger head.
Figure 2:
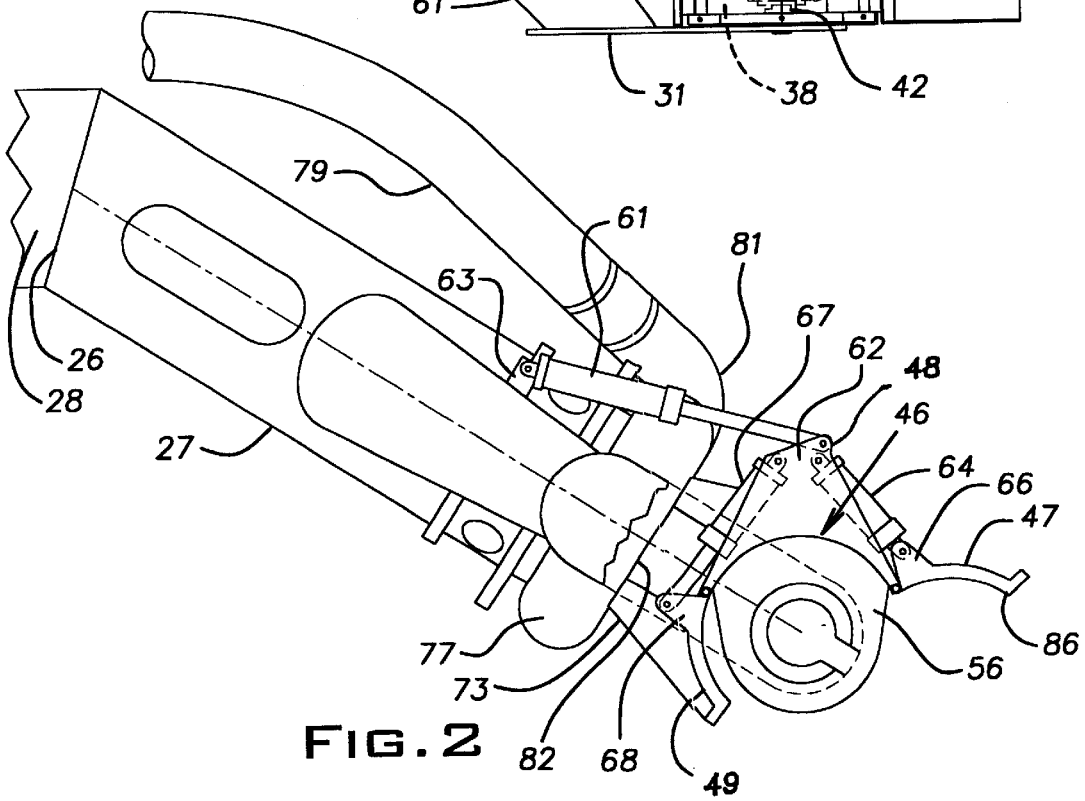
FIG. 2 is a somewhat schematic side elevational view of a lower section of the dredge ladder and suction auger head of the invention.

With particular reference to FIGS. 2 and 3, the free lower section 27 of the ladder 17 includes a pair of tubular arms 29 diverging at oblique angles to the axis of this lower section 27. The arms 29 and lower ladder section have longitudinal axes that are coplanar. The arms 29 are welded to the wall of the lower ladder section 27. Ends of the arms 29 distal from the lower ladder section are welded to respective parallel plates 31 that extend forwardly beyond the tubular main body of the lower ladder section 27.

An elongated auger 36 extends between the plates 31. The auger comprises left and right-hand helical sheet metal screw sections 37, 38 respectively, and a tubular shaft 39 about which the screws 37, 38 are wrapped and welded. The sheet metal screws 37, 38 provide peripheral cutting edges 41 and urge bottom material axially towards the longitudinal or lengthwise center of the auger head 21. The auger 36 is rotationally supported by a bearing 42 on the starboard side plate 31 and by a hydraulic motor 43 at the opposite or port side plate 31.

Figure 8:
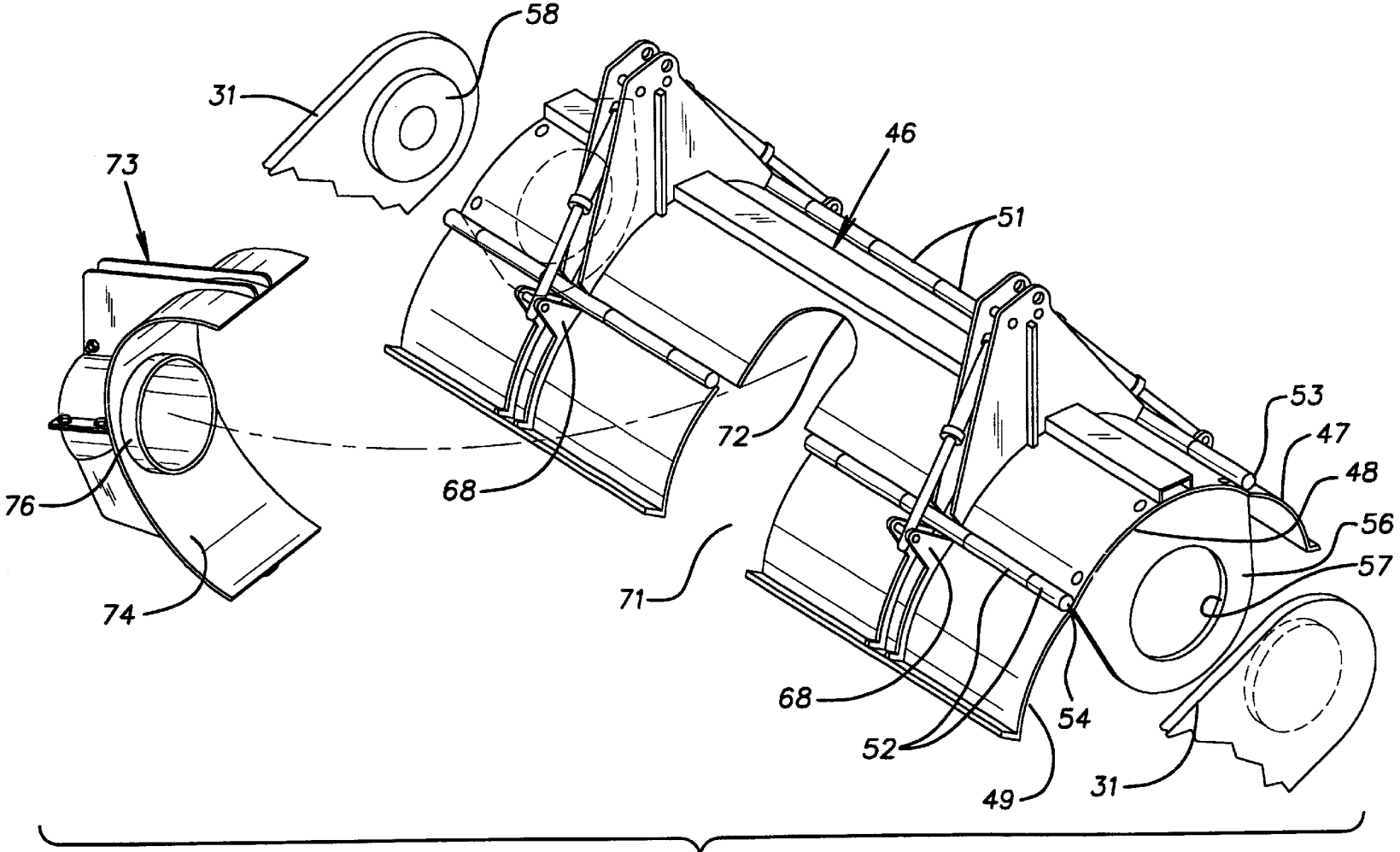
FIG. 8 is a schematic exploded perspective view of a shroud assembly of the suction auger head.

A shroud assembly 46 covers a major portion of the circumference of the auger assembly 36. The shroud assembly 46 includes front, center and rear sections 47–49 respectively. Each of the sections 47–49 is fabricated of sheet steel rolled or otherwise formed into cylindrical shell segments with an inside radius moderately but not substantially larger than the outside diameter of the auger screws 37, 38 to provide a practical working clearance therewith. The rear shroud section 49, as most clearly shown in FIG. 8, has two separate parts, one at the right (starboard) and one at the left (port). The front and rear shroud sections 47, 49 are each pivoted with respect to the center section 48. Piano hinge-like structures 51, 52 coupling the front and rear sections to the center section 48, respectively have a hinge or pivot center 53, 54 adjacent the proximate longitudinal edges of each of these sections and the respective proximate longitudinal edges of the center section.

The center shroud section 48 is bolted or otherwise fixed to end plates 56, one at each of its ends. The end plates 56 have large circular holes 57 that are concentric with the center of curvature of the center shroud section. The end plates 56 are mounted on annular discs or tracks 58 fixed to the inside faces of the plates 31. The holes 57 and tracks 58 are dimensioned to enable the end plates 56 to pivot freely on the tracks thereby allowing the center shroud section to pivot about the axis of the auger 36. The angular position of the center shroud section 48 about the auger 36 relative to the ladder 17 is selectively adjustable by operation of a pair of hydraulic piston and cylinder actuators 61. One end of each actuator 61 is connected to a bracket 62 fixed on the center shroud section 48 and the other end is connected to a bracket 63 fixed to an associated arm 29 of the lower ladder section 27.

The position of the front shroud section 47 about the hinge axis 53 relative to the center shroud section 48 is selectively adjustable by operation of a pair of hydraulic piston and cylinder actuators 64 connected at one end to an associated bracket 62 on the center shroud section 48 and at the other end to a bracket 66 fixed on the front shroud section. Similarly, the position of each of the rear shroud section parts 49 about the hinge axis 54 relative to the center shroud section 48 is selectively adjustable by operation of an associated hydraulic piston and cylinder actuator 67 connected at one end to a respective bracket 62 and at the other end connected to a bracket 68 on the associated rear shroud section part 49.

The rear shroud section parts 49 are separated by a gap 71 adjacent the mid-length of the auger 36. A notch 72 is cut in the rear edge of the center shroud section 48 and forms an extension of the gap 71 in the circumferential direction with reference to the periphery of the auger. The opening in the wall of the shroud assembly 46 formed by the gap 71 and notch 72 is covered by a fixed inlet shroud 73. The fixed inlet shroud 73 is a weldment of steel sheet stock that includes an arcuate sheet 74 having a radius of curvature to fit over the outside surface of the shell or wall of the center shroud section 48. Additionally, the fixed inlet shroud 73 includes a steel tube that fits into the wall opening of the gap 71 and covers the notch 72.

Mounted on the lower ladder section 27 closely adjacent the auger 36 is a suction pump 77. The pump 77 is driven by a hydraulic motor (not shown) or other suitable means mounted within the lower ladder section 27 which motor is powered by the hydraulic pump operated by the power plant 12 in a conventional manner.

An inlet 82 of the pump is coupled by the fixed inlet shroud tube 76 so that the suction of the pump is applied through the shroud opening of the gap and notch 71, 72 to the working space of the auger surrounded by the shroud assembly 46. A flexible duct or pipe 79 is connected to an outlet 81 of the suction pump 77 and carries material discharged by the suction pump to a remote location where it is received by a barge or other collection point.

Figure 5:
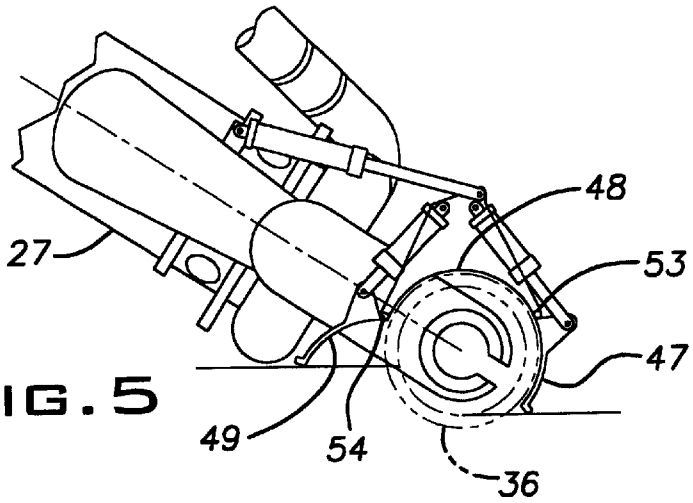
FIG. 5 is a view similar to FIG. 4 illustrating the suction auger head in a shallow reverse digging mode.
Figure 7:
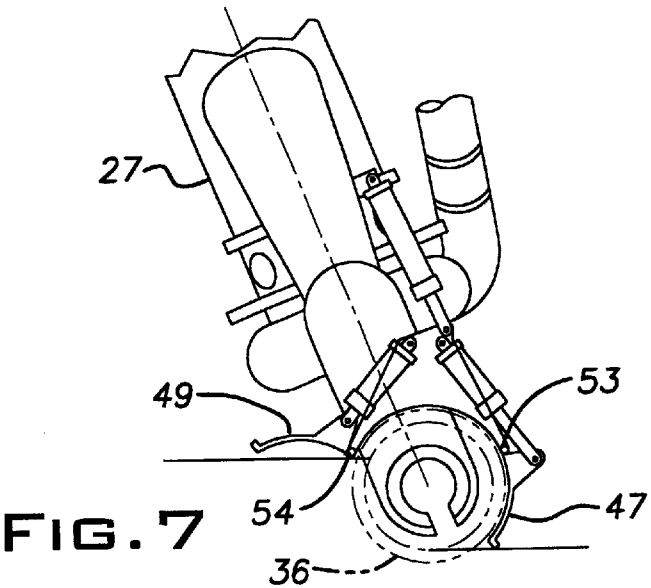
FIG. 7 is a view similar to FIG. 6 with the suction auger head in a deep reverse digging mode.
Figure 4:
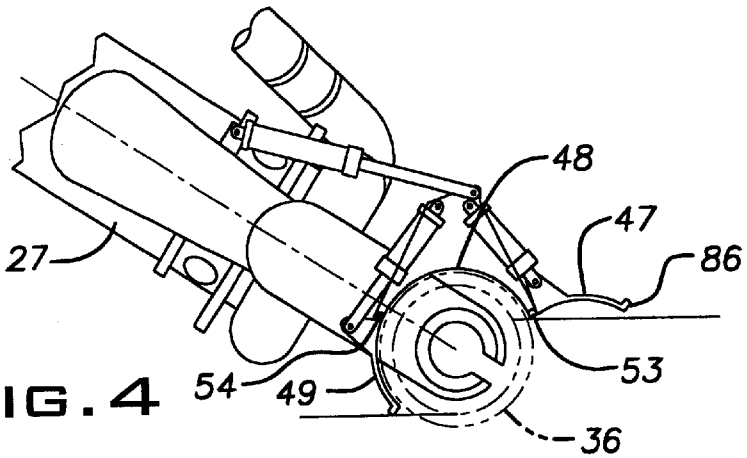
FIG. 4 is a schematic side elevational view of the suction auger head in a shallow forward digging mode.
Figure 6:
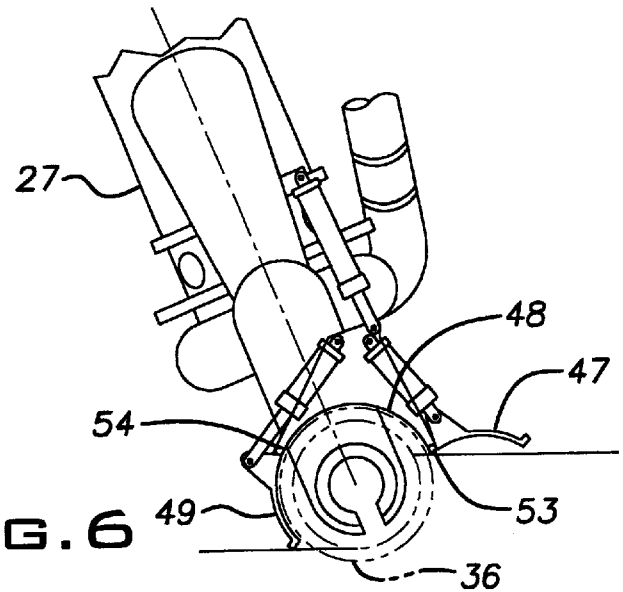
FIG. 6 is a schematic side elevational view of the suction auger head in a deep forward digging mode.

In operation, the lower or free end section 27 of the ladder 17 is lowered with the actuator 22 to a depth preferably where a large fraction of the height of the auger 36 can work on the bottom. FIGS. 4 and 5 show forward and reverse dredging action where the bottom is at a relatively shallow depth. FIGS. 6 and 7 similarly show forward and rearward dredging where the bottom is relatively deep.

In the shallow dredging condition such as depicted in FIGS. 4 and 5, the actuators 61 have their piston rods extended to rotate the shroud assembly 46 about the axis of the auger 36 clockwise relative to the ladder 17. Typically, this is done to position the center shroud section 48 with an attitude where the front and rear hinge axes 53, 54 are generally in a common horizontal plane. In the forward digging operation, the front shroud section 47 is opened so that a forward or free edge 86 is at least as elevated as its rear hinged edge and preferably is slightly higher. At the same time, the actuators 67 hold the rear shroud section parts closed so that they are close to the periphery of the auger 36.

In the reverse shallow depth digging action, the center section 48 remains in the attitude where the hinge axes 53, 54 are at or near a common plane but the opened and closed positions of the front and rear shroud sections 47, 49 are reversed by selective operation of their respective actuators 64 and 67.

With reference to FIGS. 6 and 7 showing deep dredging operation, the operational strategy is similar. The actuators 61 retract their piston rods to rotate the shroud assembly 46 counterclockwise relative to the ladder 17 again producing an attitude of the shroud assembly where the front and rear hinge axes 53, 54 are generally in a common horizontal plane. In the forward direction, the front shroud section 47 is fully opened and the rear shroud section 49 is fully closed. In the reverse direction, these positions are reversed by selective operation of their respective actuators 64, 67.

A study of FIGS. 4–7 shows that in all the illustrated conditions of digging, the leading shroud section, i.e. the front shroud section 47 in forward operation or the rear shroud section 49 in reverse operation closely hover over the bottom surface. The same is true of the trailing shroud section, i.e. the rear shroud section 49 in the forward operation and the front shroud section 47 in the rearward operation. This close fitting of the leading and trailing shroud sections to the profile of the bottom as it is being dredged into the auger by the center section and the closed trailing one of the front or rear shroud sections substantially reduces turbidity in the flow of material being worked by the auger 36 and suctioned by the pump 77. This reduction of turbidity produces a corresponding increase in efficiency. The articulation afforded by the front and rear shroud sections 47, 49 by their hinge or pivot mounting to the center section 48 and the pivotal mounting of the center section to the lower ladder section 27 produced by pivoting of the end plates 56 on the tracks 58 affords a suction auger dredge head that is essentially as efficient in the rearward dredging direction as in the forward dredging direction.

As shown, the center shroud section 48 wraps about the periphery of the auger through an angle of at least 90° while each of the front and rear shroud sections 47 and 49 wrap around the auger 36, when closed, at least about 45°. When either the front or rear shroud section is closed, there is a shrouding effect directly around the auger of preferably at least about 180°. FIGS. 4–7 illustrate relatively full cuts by the auger; where it is desired to make less than a full cut the forward or rear shroud, whichever is leading, is opened by the respective actuators to a less than full open position.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suction auger for a ladder on a dredge comprising an auger, the auger being supported for rotation about its central axis, the axis being disposed in a generally horizontal plane, a shroud assembly surrounding a substantial portion of the periphery of the auger, the shroud assembly including forward, center and rear sections, the forward and rear sections each being independently movable from a closed position where it is adjacent the periphery of the auger and an open position where it exposes the auger for working the bottom, the shroud assembly being selectively pivotal about the axis of the auger so that the center shroud can be held at a relatively constant attitude throughout changes in the angle of the ladder, and a suction pump connected to the interior of the shroud assembly.

2. A suction auger as set forth in claim 1, wherein the front shroud section is pivoted relative to the center section.

3. A suction auger as set forth in claim 1, wherein the rear shroud section is pivoted relative to the center section.

4. A suction auger as set forth in claim 1, wherein the front shroud section has an edge adjacent the center section and is pivotal on the center section about an axis adjacent said edge.

5. A suction auger as set forth in claim 1, wherein the rear shroud section has an edge adjacent the center section and is pivotal on the center section about an axis adjacent said edge.

6. A suction auger as set forth in claim 1, wherein the center shroud section surrounds about at least 90° of the periphery of the auger and the front and rear shroud sections are each capable of surrounding about at least 45° of the periphery of the auger.

7. A suction auger as set forth in claim 6, wherein actuators for displacing the front or rear shroud sections between their open and closed positions are carried on the shroud assembly.

8. A suction auger as set forth in claim 7, wherein the front and rear shroud sections are pivoted to the center shroud section with piano-type hinge connections at their respective adjacent edges.

9. A dredging apparatus comprising a hull, a power plant on the hull, a ladder pivotally supported about a generally horizontal axis at one end on the hull, a suction auger head at a free end of the ladder, an actuator device for raising and lowering the free end of the ladder, the head including an auger mounted on the free end of the ladder for rotation about a generally horizontal axis, a shroud assembly surrounding a substantial portion of the periphery of the auger, the shroud assembly including forward, center and rear sections, the forward and rear sections each being independently movable from a closed position where it is adjacent the periphery of the auger and an open position where it exposes the auger for working the bottom material, the shroud assembly being selectively pivotal about the axis of the auger so that the center shroud can be held in a relatively constant attitude throughout changes in the angle of the ladder, and a suction pump driven by the power plant and connected to the interior of the shroud assembly.

* * * * *